United States Patent [19]

Silber

[11] 4,202,456

[45] May 13, 1980

[54] TOY UTILIZING USED, DISCARDABLE ITEMS SUCH AS BOTTLE CAPS AND BEVERAGE CANS

[76] Inventor: David Silber, 1320 53rd St., Brooklyn, N.Y. 11219

[21] Appl. No.: 881,784

[22] Filed: Feb. 27, 1978

[51] Int. Cl.[2] ..... B65D 51/24

[52] U.S. Cl. ..... 215/228; 220/380

[58] Field of Search ..... 215/228, 250, 251; 220/380

[56] References Cited

FOREIGN PATENT DOCUMENTS 2042403 3/1972 Fed. Rep. of Germany ..... 215/228

2511375 10/1976 Fed. Rep. of Germany ..... 215/228

*Primary Examiner*—George T. Hall

*Attorney, Agent, or Firm*—Thomas Langer

[57] ABSTRACT

Readily available and normally discardable items are modified for attachment one to another as parts in constructing a desired structure. In one embodiment, the top of a twist-on type of bottle cap is extended to duplicate the threaded portion of a bottle top. In another embodiment, the bottom of a bottle cap is provided with a skirt having an annular groove on its inside surface. The top of the cap is provided with an annular flange designed to snap into the groove of an identical cap. The caps can be stacked by twisting one onto another (first embodiment) or snapping one onto another (second embodiment). Punch-outs are provided on the periphery of the caps to be used in combination with a fastening means, such as rivets, to attach the caps side by side. Beverage cans are provided with similar adaptations.

8 Claims, 4 Drawing Figures

FIG. 1
PRIOR ART
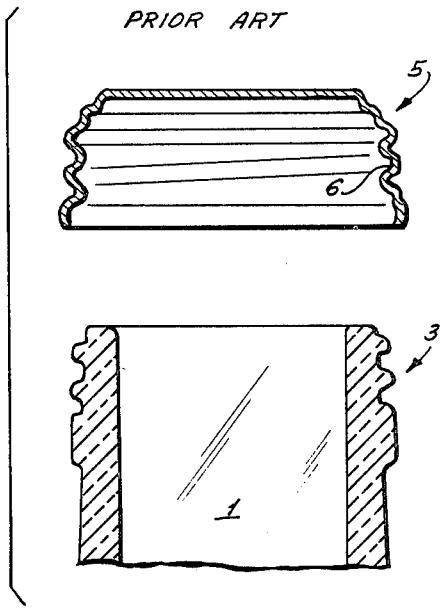
FIG. 2
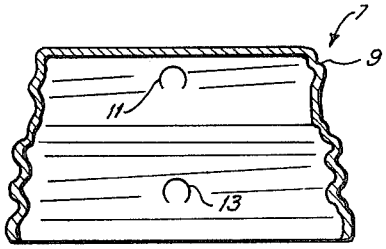
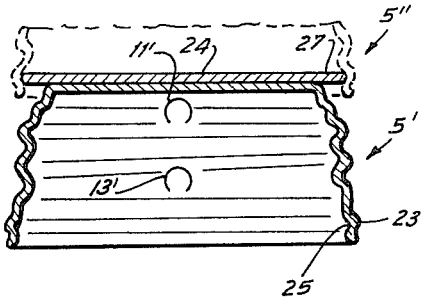
FIG. 4
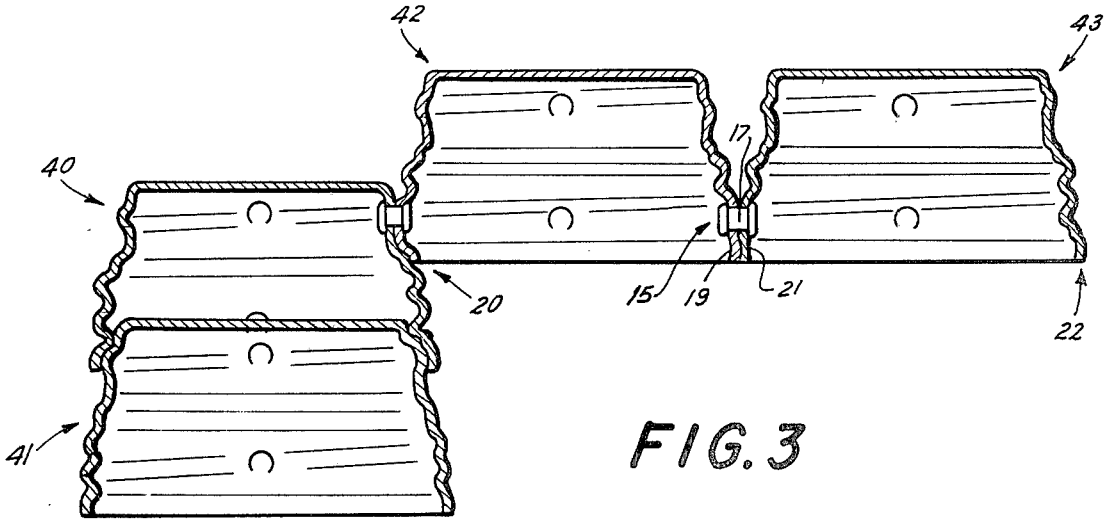
FIG. 3

TOY UTILIZING USED, DISCARDABLE ITEMS SUCH AS BOTTLE CAPS AND BEVERAGE CANS

BACKGROUND OF THE INVENTION

The present invention is directed to a toy and, more particularly to a commonly available item such as a bottle cap or beverage can modified to be readily attached to other such items to form a variety of differently shaped structures.

It has long been desirable to develop some way of adapting commonly available, cheap, and normally disposable items for use as a toy. The primary advantage sought is the low cost of such a toy since the basic parts are originally utilitarian, and bought as such, and later become disposable. In addition, these are normally bought in great quantities over a period of time and would thus be normally always available around the house. Bottle caps and various types of cans, such as beer cans or soda cans, are exemplary of such items. U.S. Pat. Nos. 3,018,583, 3,154,882, and 3,815,281 disclose various modifications of a beverage can for use as a toy while U.S. Pat. No. 3,186,127 discloses a bottle cap of the crimped metal type which serves mainly as a support base for different figures made of paper and/or metal.

The disadvantages of all of these approaches lies in the extra parts required so that use of the caps and cans is feasible as well as interesting and attractive. These parts must be bought in a store or built in the house, stored, and then somehow connected to each other, thereby adding to the cost of the toy and making its use awkward and inconvenient. It is possible that these considerations have prevented any of the previous approaches from becoming a commercial success.

SUMMARY OF THE INVENTION

It is, therefore, a primary object of the invention to utilize cheap, otherwise discardable items for use as a toy with a minimal number of additional parts required.

Another object of the invention is to provide a toy enabling the construction of various shapes with building blocks of cheap, readily obtainable parts normally available around the house.

A further object of the present invention is to provide items readily available around the house which need to be only slightly modified to enable attachment one to another without having to use separate attachment means.

These and other objects are attained in accordance with one aspect of the present invention which utilizes a standard or twist-on type of bottle cap modified somewhat in two ways. Firstly, the top is extended upward, tapered and threaded to duplicate the topmost portion of the bottle. This allows the tapped lowermost portion of one cap to be attached to the threaded topmost portion of another, just as if it were twisted onto the bottle. The two are thus easily, conveniently, and securely attached without glue, screws, or the like. Secondly, punch-outs are spaced around the periphery of the cap. Caps can be attached side-by-side simply by passing the shank of a rivet through aligned holes after the punch-outs have been removed and a conventional crimping tool is then used to complete the attachment. By having punch-outs in both top and bottom portions of the cap, they can be attached either on the same level or offset in height from each other.

In accordance with another aspect of the invention, a standard twist-type of bottle cap is modified in three ways. Firstly, the bottom portion is somewhat extended and flared downward and provided with an annular groove on the inside surface. Secondly, an annular flange is placed at the top of the cap and is dimensioned to snap into the annular groove. This allows two caps to be securely attached one to another by simply snapping them together. Thirdly, the bottle cap is also provided with the punch-outs discussed above.

Other commonly available items such as beverage cans can also be slightly modified in accordance with the teachings of the present invention to screw on or snap together as well as to include the above mentioned punch-outs. Although for purposes of simplicity and succinctness most of the remainder of this discussion will explicitly deal only with bottle caps, it should be understood that this term includes all items, such as beverage cans, which are sold in great numbers to the public and are modifiable in a manner similar to that of the bottle caps.

BRIEF DESCRIPTION OF THE DRAWINGS

To the accomplishment of the above and to such other objects as may hereinafter appear, the present invention relates to a toy using as building blocks somewhat modified versions of commonly available and discardable items found around the house, as defined in the appended claims and as described in this specification, taken together with the accompanying drawings, in which:

FIG. 1 is an elevational view in cross section of a standard twist-on type of bottle cap and the corresponding top, threaded portion of a bottle;

FIG. 2 is an elevational view in cross section of twist-on type of bottle cap depicting one embodiment of the present invention;

FIG. 3 is an elevational view in cross section showing several caps such as the one shown in FIG. 2 connected to each other; and FIG. 4 is an elevational view in cross section of a twist-on type of bottle cap depicting another embodiment of the present invention.

DETAILED DESCRIPTION OF THE DRAWINGS

Sealed bottles are proliferately used to store, transport and dispense a great variety of liquids. Increasingly, such bottles are sealed at the factory or the bottling plant with screw-on type bottle caps. These are popular because a tool is not needed to open the bottle and possibly more importantly because they can be used to effectively reclose the bottle when some of the liquid still remains to be dispensed. This is not the case with the crimped metal type of bottle cap, which must be bent out of shape when originally removed and thus cannot readily act again as an effective seal. Due to the extensive use of twist bottle caps, a great number of these pass through the typical household in even a relatively short period of time. They are retained until their utility ends with the emptying of the bottle, and are then discarded. However, should they be collected instead, one would easily have large quantities of such an item at no cost. Consequently, if they can be modified in a suitable manner, as discussed below, one would have an abundant supply of parts at no cost for use as a toy. The modifications, according to the present invention, unlike those found in other approaches to date, are such as to enable their being made by the bottle cap manufacturers rather than by the users. Thus, a minimum of additional effort by the purchaser is necessary to ready the bottle caps for use as toys.

Turning now more specifically to FIG. 1, a bottle 1 is shown for purposes of illustration as having a standard threaded portion 3 at the top. Shown directly above it in a position just preparatory to lowering it on the bottle is a conventional bottle cap 5 suitably tapped, as at 6, so that it can easily be twisted onto top portion 3 of the bottle to form an effective seal. Some bottle caps come originally with a frangible bottom (not shown) in tight contact with the neck of the bottle and which splits into sections upon initial turning of the cap. Alternatively, the bottle cap may have a separable ring (not shown) at the bottom sealed against the neck of the bottle and which breaks away from it when the cap is first twisted. For purposes of simplicity and succinctness, these are not shown since they have no direct relation to the invention.

In accordance with a first embodiment of the invention, and as shown in FIG. 2, the conventional bottle cap is extended upward to form its topmost section 7. It is slightly tapered so as to duplicate the outside diameter of the topmost portion of bottle 1. Furthermore, a helical thread 9 is provided duplicating the initial thread of bottle 1 first encountered by cap 5 as it is twisted onto the bottle. As used here, the topmost portion of the bottle is meant to include that threaded part engaged by the cap from initial threaded contact until approximately a 180° twist. In this manner, each bottle cap inherently is capable of attachment to an identical cap 5. All that needs to be done is to twist one on top of another for a secure attachment. See, for example, caps 40 and 41 in FIG. 3. Any number can be stacked in this manner, as desired. An important advantage to note is that, as far as the user is concerned, the attachment involves absolutely no additional parts or materials and is accomplished at no cost since the caps come with this capability. Furthermore, the caps can easily be separated for reuse in building another structure.

Another modification to the standard bottle cap is required to be able to attach the caps side by side. To this end, each cap is provided with punch-outs 11 and 13. During normal usage of the cap, the punch-outs function just as any other integral portion of the cap to seal the bottle. However, when its usefullness as such is ended, any punch-out can be removed with a blow, in a well known manner. Each cap is preferably provided with four each of punch-outs 11 and 13 spaced at 90° intervals around the periphery of the cap. Punch-outs 11 are placed toward the top of the cap while punch-outs 13 are located toward the bottom. This provides added versatility for connecting the caps into a variety of shapes. More specifically, to connect two caps to each other on the same level, punch-outs 11 and 13 of the two caps are respectively aligned with each other. See, for example, caps 42 and 43 in FIG. 3. To offset the caps, however, one need only to align punch-out 11 of one with punch-out 13 of the other. See, for example, caps 40 and 42 of FIG. 3. A great number of combinations is, thus, possible to form shapes and structures primarily limited only by one's imagination.

To fasten the caps utilizing the punch-outs, some additional parts are needed. These are rivets, as shown in FIG. 3, whose shank 17 is passed through aligned holes in the walls 19 and 21 of the adjacently placed caps. A readily available crimping tool (not shown) is then used to flatten the rivet on the inside of each cap, and the two caps are thus firmly fastened together. Due to the slight taper of the caps, the bottom of the remote ends 20 and 22 of the assembly of the two attached caps 42 and 43 may be raised upward a bit in relation to the center portion of the assembly. However, since the caps are not rigid and have a slight "give", one can easily bend them slightly to obtain a level bottom for the assembly.

Although a separate fastening means is required for the just-described task, the parts are relatively cheap, readily obtainable and easy to use. The attachment of caps in this manner should, therefore, be convenient and fast.

FIG. 4 depicts the second embodiment of the present invention. Again, as in FIG. 1, a conventional bottle cap is used as the basic structure generally depicted by 5'. The modifications to it in accordance with the invention are as follows: A narrow skirt 23 is added to the bottom of cap 5'. It is slightly flared to prevent interference with the threads on bottle 1 (FIG. 1). Skirt 23 includes on its inside surface an annular groove 25. The top of cap 5' is provided with a circular plate 26 of a somewhat larger diameter to form an annular flange 27, forming a snap ring and sized to fit securely within the groove of an identical cap 5" shown in broken lines. Flange 27 is, of course, rounded at the edges to prevent injury and may be vertically notched to facilitate turning of the cap.

In use, any number of bottle caps can be stacked simply by snapping flange 27 of one into groove 25 of another. Again, no additional parts are required for this attachment since the necessary modifications are an inherent part of the cap. Likewise, separation of the caps is simple and convenient.

This embodiment also is provided with punch-outs 11' and 13' in the same manner and for the same reasons as discussed with regard to the first embodiment to form the structures exemplified by FIG. 3.

Only bottle caps have been discussed up to now, with this term being taken to include similar commonly available and disposable items such as beverage cans to which the teachings of this invention can be applied, as mentioned above. For example, as concerns beverage cans, the top, vertically extending flange of each can may be threaded as shown in FIG. 1. Also, the bottom flange is extended slightly downward and tapped to cooperate with the threads at the top of an identical can. Likewise, in another embodiment, a laterally extending flange is provided at the top of the can which snaps into an annular groove in a slightly extended skirt at the bottom of the can in a manner similar to that of the FIG. 2 embodiment. Also, the cans of both embodiments are provided with punch-outs at the top and bottom, and possibly elsewhere for the reasons discussed above. It is believed that the details supplied with reference to the bottle caps are sufficiently clear and detailed so that no further discussion of the can modifications is necessary.

The toy, as mentioned above, would be an assembly of bottle caps attached in practically any way which one can imagaine. Moreover, the structure can comprise a mix of bottle caps and beverage cans as well to further add to the flexibility of the toy.

While but two embodiments of the present invention have been here specifically disclosed, it will be apparent that many variations may be made therein. For example, in the embodiment of FIG. 4, skirt 23 may be dispensed with and flange 27 designed to snap into an existing tap in cap 5. Also, flange 27 may be an integral part of the bottle caps. Furthermore, more or less punch-outs than the four disclosed can be spaced around the periphery of the cap. Finally, fastening means other than rivets can be used in the punch-outs. These and other such changes are all within the spirit and scope of the invention as defined by the following claims.

I claim:

1. A twist-on bottle cap for use as a toy in constructing an assembly of a plurality of identical such bottle caps attached to each other to form various shapes, and comprising a tapped body portion adapted for normal attachment to a threaded bottle top, a top portion adapted to be securely received within the body portion of an identical bottle cap, and a plurality of punch-outs positioned at spaced intervals around the periphery of said bottle cap.

2. The bottle cap of claim 1, wherein the top portion comprises a threaded, tapered extension of a standard bottle cap duplicating the topmost portion of a standard bottle top.

3. The bottle cap of claim 1, wherein the top portion comprises a lateral flange adapted to fit securely into a groove of the body portion.

4. The bottle cap of claim 3, wherein said groove is on the inside surface of a lower extension of a standard bottle cap.

5. The bottle cap of claim 1, wherein said punch-outs comprise a set of two having one at the top and one at the bottom of said cap.

6. The bottle cap of claim 1, wherein a plurality of said sets are positioned around the periphery of said bottle cap.

7. A toy comprising a plurality of identical bottle caps attachable one to another to construct a desired assembly, each of said bottle caps comprising a threaded body portion adapted for normal attachment to a threaded bottle top, a top portion threaded and of a size to duplicate the topmost portion of said bottle top, and a plurality of punch-outs positioned at spaced intervals around the periphery of said bottle cap.

8. A toy comprising a plurality of identical bottle caps attachable one to another to construct a desired assembly, each of said bottle caps comprising a threaded body portion adapted for normal attachment to a threaded bottle top, an annular groove on the inside of the bottom portion of said cap, a snap ring at the top of said bottle cap adapted to snap into the annular groove of an identical bottle cap, and a plurality of punch-outs positioned at spaced intervals around the periphery of said bottle cap.

* * * * *